US005873063A

United States Patent [19]

Wu et al.

[11] Patent Number: 5,873,063

[45] Date of Patent: Feb. 16, 1999

[54] LSP SPEECH SYNTHESIS DEVICE

[75] Inventors: Xingjun Wu; Yihe Sun, both of Beijing, China

[73] Assignee: United Microelectronics Corporation, Hsin-Chu, Taiwan

[21] Appl. No.: 857,866

[22] Filed: May 16, 1997

[51] Int. Cl.[6] ..... G10L 3/00

[52] U.S. Cl. ..... 704/258; 324/76.28; 364/724.011

[58] Field of Search ..... 375/350; 324/76.28; 364/724.17, 724.19; 704/258

[56] References Cited

U.S. PATENT DOCUMENTS 5,524,244 6/1996 Robinson ..... 395/800.36

5,590,349 12/1996 Robinson et al. ..... 364/474.24

OTHER PUBLICATIONS

"Digital Speech Processing Synthesis and Recognition," Sadaok; Furnin, ISBN 0–8247–7965–7, pp. 126, 133.

*Primary Examiner*—David R. Hudspeth

*Assistant Examiner*—M. David Sofolleous

*Attorney, Agent, or Firm*—Rabin & Champagne, P.C.

[57] ABSTRACT

A speech synthesis application specific integrated circuit (ASIC) based on an Line Spectrum Pair (LSP) scheme. In the ASIC, the LSP parameter is encoded and two's complement fixed-point serial pipeline arithmetic operations with rounding are performed by an LSP speech synthesis digital filter. The operating rate demanded for the ASIC is low, and the elements of the ASIC are mostly in serial shift structure. So, the area of the LSP speech synthesis ASIC is much less than the conventional chip.

6 Claims, 3 Drawing Sheets

LSP SPEECH SYNTHESIS DEVICE

BACKGROUND OF THE INVENTION

1. Field of the Invention

The invention relates in general to an LSP (Line Spectrum Pair) speech synthesis device, and more particularly to a speech synthesis ASIC (Application Specific IC) based on an LSP scheme. LSP speech synthesis is based on an improved algorithm previously derived from PARCOR (Partial Correlation). It requires only 60% of the bit rate required for PARCOR synthesis and still maintains the same level of quality. According to the invention, it needs an LSP synthesis digital filter to perform operations of the algorithm. The LSP synthesis digital filter consists of only one serial shift multiplier, four serial adders, four multiplexers and some registers to perform the operations of the algorithm. In addition, the sampling rate needed to perform the operations is lower so that the needed area of the speech synthesis ASIC for data storage, for example, is lesser.

2. Description of the Related Art

In the past several years, semiconductor companies have developed many speech synthesis chips and have found a great number of applications for them, including, for example, toys, personal computers, car electronics, and home electronics. In these chips, the PARCOR algorithm of LPC (linear predictive coding) is widely used. The functions of LPC are described as follows:

A speech data output signal s(n) is extracted from an excitation signal e(n) through a digital filter having a transfer function H(z). That is to say: s(n)=H(z)×e(n).

The transfer function of the filter H(z) can be described as:

$$H(z) = G/A(z) = G/\left(1 - \sum_{i=1}^{p} a_i z^{-i}\right)$$

The linear predictive error $$A(z)\left(= 1 - \sum_{i=1}^{p} a_i z^{-i}\right)$$

has coefficients $\{a_i\}$ called linear predictive coefficients. The parameter p is called the linear predictive order. In the time domain, the speech data signal s(n) can be described as follows:

$$s(n) = G \times e(n) + \sum_{i=1}^{p} a_i \times s(n-i)$$

The speech data signal s(n) can be considered to be a linear combination of the past p speech data signal values s(n-i) and the excitation signal e(n). In LPC, the excitation signal e(n) is hite noise," and the coefficients $\{a_i\}$ and G represent speech data, wherein the coefficients $\{a_i\}$ are the frequency data and G is energy.

If the coefficients $\{a_i\}$ are directly encoded, then to ensure the stability of the filter, each of the coefficients will be more than 10 bits. That is to say, high precision of the coefficients $\{a_i\}$ is necessary. In fact, the PARCOR algorithm is widely used. The reflective coefficients $\{k_i\}$ of that algorithm represent frequency data. On the condition that $|k_i|<1$, the stability of the filter can be ensured and the bit number will be reduced. There is therefore a need in the widely used speech synthesis ASIC to lower the bit rate in order to form a smaller configuration chip.

The PARCOR analysis-synthesis method is superior to any other previously developed methods, but it has a lowest bit rate limit of 2400 bps. If the bit rate falls below this value, the synthesized voice rapidly becomes unclear and unnatural. The LSP method was thus investigated to maintain voice quality at smaller bit rates (Itakura, 1975). The PARCOR coefficients are essentially parameters operating in the time domain as are the auto-correlation coefficients, whereas the LSPs are parameters functioning in the frequency domain. Therefore, the LSP parameters are advantageous in that the distortion they produce is smaller than that of the PARCOR coefficients, even when they are roughly quantized and linearly interpolated.

Optimum coding of LSP parameters can be realized by means of the same subjective and objective evaluation methods used for PARCOR analysis-synthesis systems (Sugamura and Itakura, 1981). Experimental studies on quantization characteristics have confirmed that if the distribution range of LSP parameters is considered in the quantization, the same spectral distortion can be realized by roughly 80% of the quantization bit rate compared with the PARCOR systems. As for the interpolation characteristics, the interpolation distortion has been demonstrated as being maintainable. As the result of the combination of these two effects, the LSP method produces the same synthesized sound quality using only roughly 60% of the bit rate as compared with that needed employing the PARCOR method. (See "Digital Speech Processing Synthesis and Recognition," Sadaok; Furnin, ISBN 0-8247-7965-7, Page 126, 133.)

SUMMARY OF THE INVENTION

It is therefore an object of the invention to provide an LSP speech synthesis device which is more efficient than the conventional ASIC, has a lower bit rate and still maintains the same level of quality as can be obtained with PARCOR synthesis.

It is another object of the invention to provide a chip with a small configuration, which inherits the advantages common to PARCOR.

In the LSP device according to the invention LSP frequencies are ordered incrementally within the signal bandwidth. With such ordering, a bit rate reduction of approximately 2 bits per parameter in comparison with arbitrary signals not specified as speech signals. Moreover, the loci of LSP frequencies are similar to those of format frequencies. They are smooth, so if they are sampled at a lower sampling rate than used for PARCOR, they can be retrieved by linear interpolation.

BRIEF DESCRIPTION OF THE DRAWINGS

Other objects, features, and advantages of the invention will become apparent from the following detailed description of the preferred but non-limiting embodiments. The description is made with reference to the accompanying drawings in which.

DESCRIPTION OF THE PREFERRED EMBODIMENT

Figure 1:
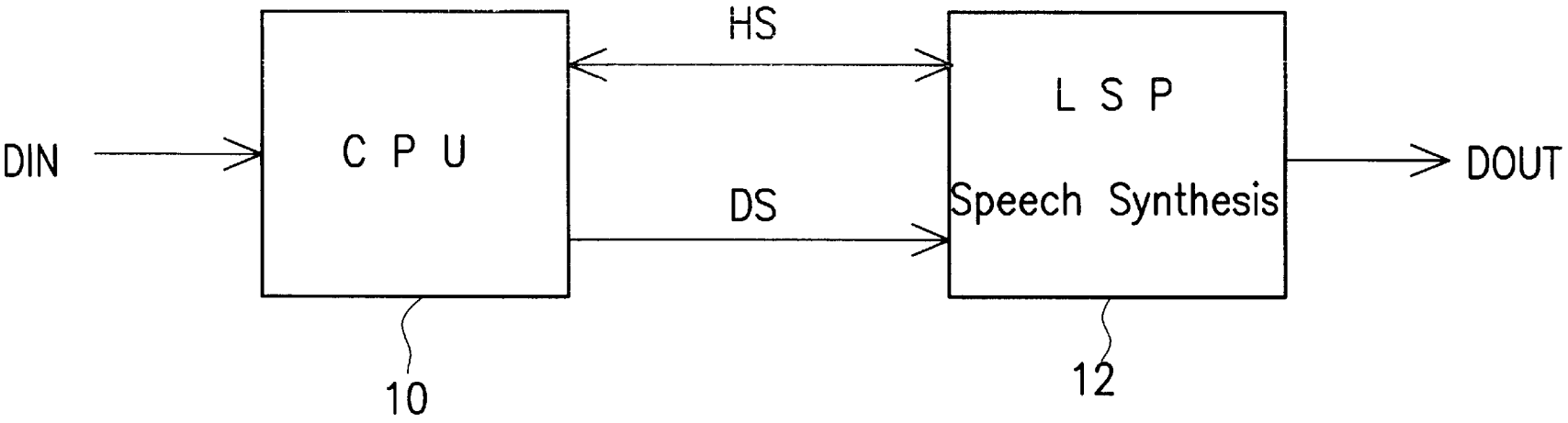
FIG. 1 (PRIOR ART)
FIG. 1 is a simple block diagram showing a connection of the LSP speech synthesizer to an external system.

Referring first to FIG. 1, showing connection of an LSP speech synthesizer 12 to its external system, encoded data DIN is provided at the input terminal of a CPU 10. The CPU 10 decodes the input encoded data DIN and outputs speech coefficients DS to the LSP speech synthesizer 12. Handshake signals HS are provided between the CPU 10 and the LSP speech synthesizer 12. The LSP speech synthesizer 12 receives the speech coefficients DS and the handshaking signals HS from the CPU 10 to begin synthesis of speech. Then, the LSP speech synthesizer 12 transfers the handshake signals HS to the CPU 10 and outputs the respective coefficient DOUT, i.e., the digital speech synthesis data s(n).

Figure 2:
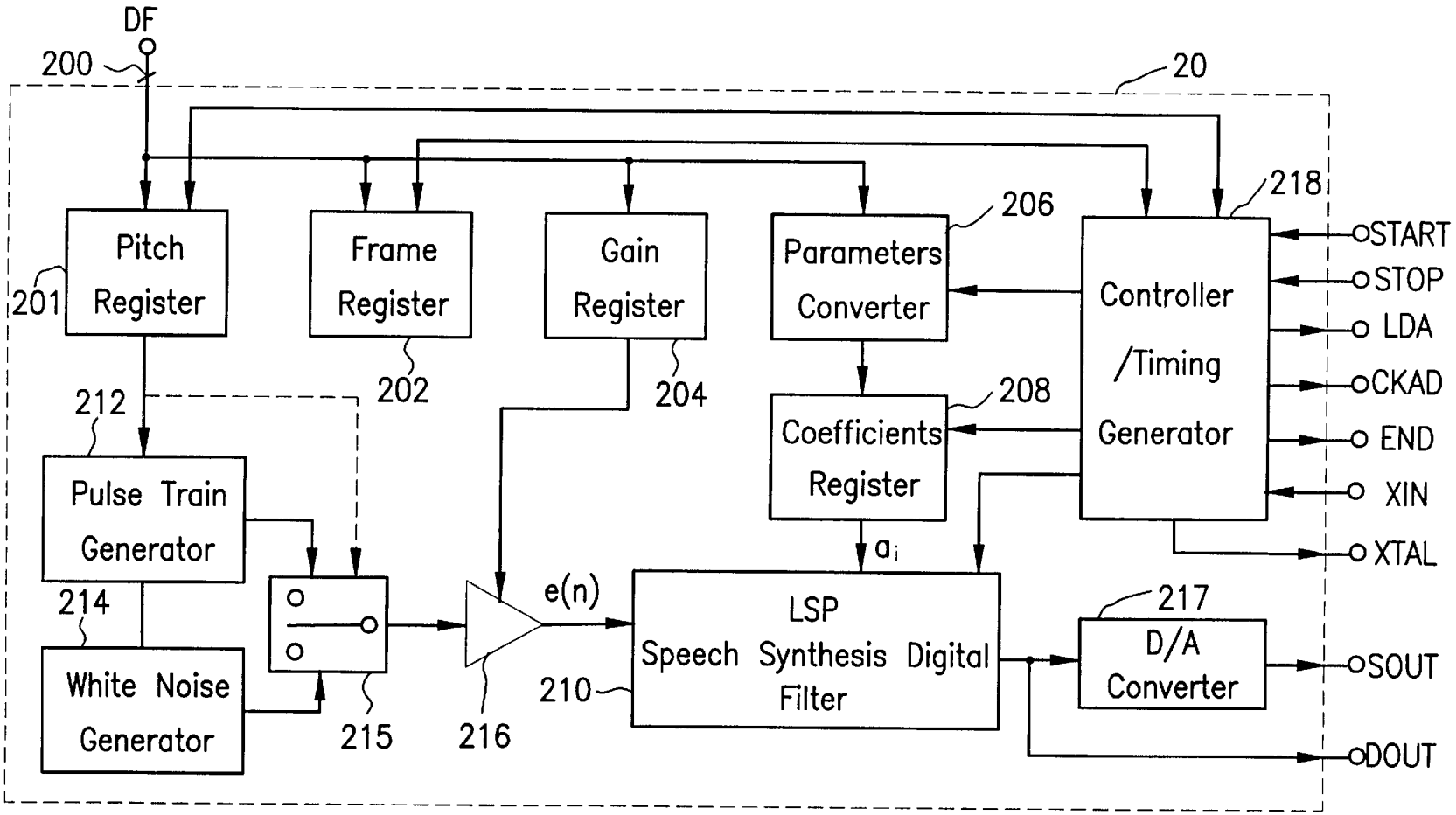
FIG. 2 is a block diagram of the LSP speech synthesis ASIC architecture.

Referring to FIG. 2, which is a block diagram of the LSP speech synthesizer ASIC architecture, a data frame DF is input to the LSP speech synthesizer ASIC 20 by a data bus 200. (DF in FIG. 2 corresponds to DS in FIG. 1, and ASIC 20 in FIG. 2 corresponds to item 12 in FIG. 1.) A pitch register 201 is used to store the pitch length of the data frame DF, and decides whether the data frame DF is a voiced or unvoiced frame (if the pitch length is 0, it is considered as an unvoiced frame), and when the pitch ends. A frame register 202 is used to store the frame length of the data frame DF, and counts the number of sampling points which have been synthesized from the beginning of this frame to the end of the frame. A gain register 204 is used just to store a gain parameter of the data frame DF. A parameter converter 206 converts the encoded LSP parameters into LSP speech synthesis coefficients $\{a_i\}$. A coefficient register 208 is used to store the LSP speech synthesis coefficients $\{a_i\}$ from the parameter converter 206. The coefficients register 208 consists of eight 10-bit shift registers and control logic. An LSP synthesis digital filter 210 receives the LSP speech synthesis coefficients $\{a_i\}$ from the coefficient register 208. The LSP synthesis digital filter 210 is the major block of the LSP speech synthesis ASIC 20, and implements all the arithmetic operations required. When the LSP speech synthesis digital filter 210 requires a coefficient, the respective coefficient is shifted out exactly from the coefficients register 208. A pulse train generator 212 generates a Hilbert sequence to simulate a voiced sound source and a white noise generator 214 generates a 15th order M-sequence for an unvoiced sound source. Both the pulse train generator 212 and the white noise generator 214 are connected to a switch 215. The voiced sound source from the pulse train generator 212 and the unvoiced sound source from the white noise generator 214 output the required sound source to the switch 215 according to the pitch length from the pitch register 201. An excitation buffer 216 receives both of the sound sources generated from the pulse train generator 212 and the white noise generator 214, and the gain parameter from the gain register 204. Then the excitation buffer 216 outputs an excitation signal e(n) to the LSP speech synthesis digital filter 210. After the LSP speech synthesis filter 210 receives the coefficients $\{a_i\}$ and the excitation signal e(n), the LSP speech synthesis filter 210 outputs digital speech synthesis data DOUT (or s(n)) to a D/A converter 217 under the control of controller/timing generator 218. The D/A converter 217 converts 8-bit digital speech synthesis data DOUT (or s(n)) to analog speech synthesis data SOUT and outputs the analog speech synthesis data SOUT. A controller/timing generator 218 generates all the control signals and timing signals to make various blocks cooperate, as required by the ASIC 20.

Figure 3:
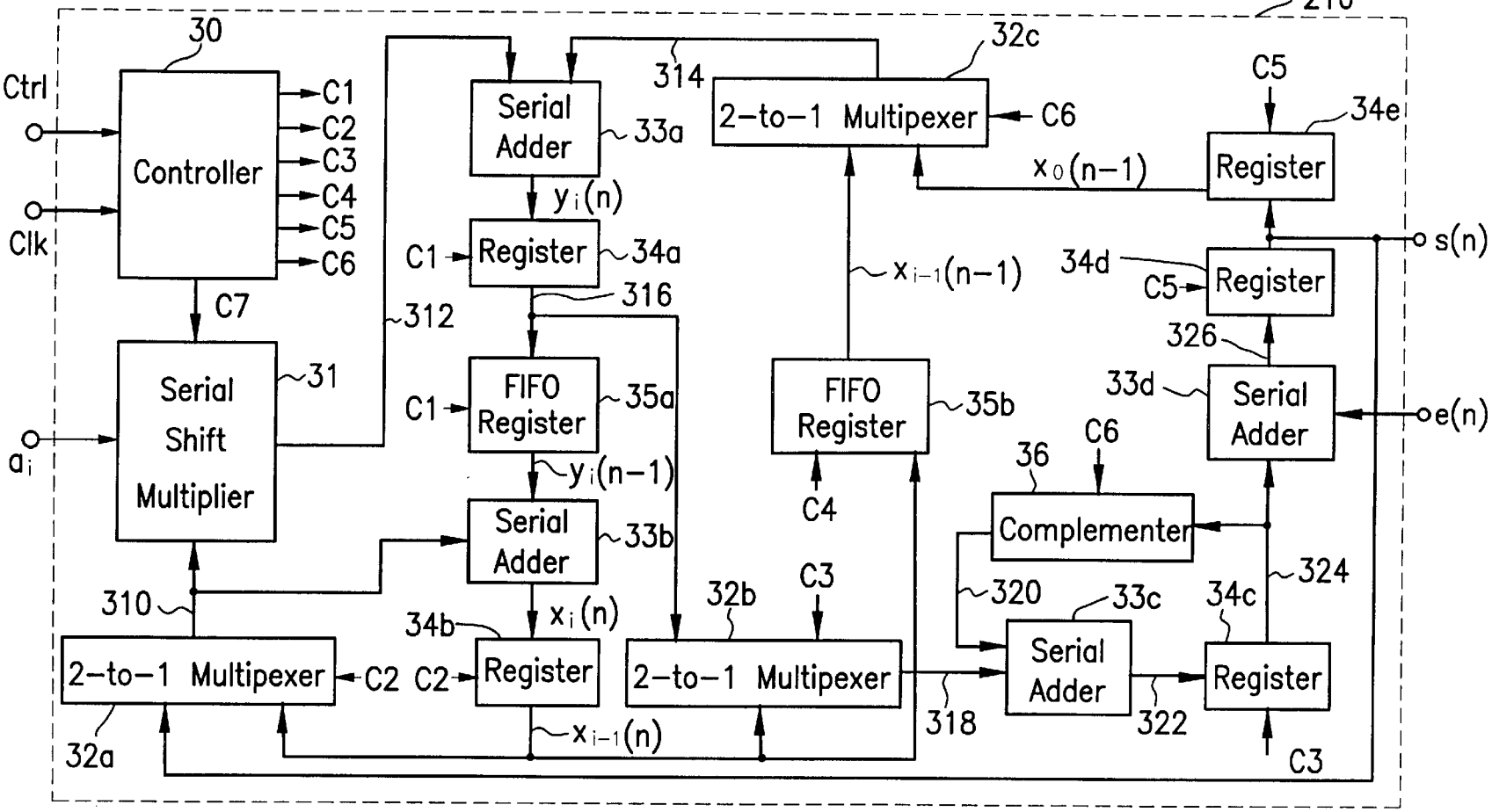
FIG. 3 is a block diagram of the LSP speech synthesis digital filter of the LSP speech synthesis ASIC.

For an LSP speech synthesis ASIC 20, the main part is the LSP speech synthesis digital filter 210 shown in FIG. 2. Referring to FIG. 3, which is a block diagram of the LSP speech synthesis digital filter of the LSP speech synthesis ASIC, for the LSP speech synthesis digital filter, two's complement fixed-point serial pipeline arithmetic operations with rounding are used to perform the following operations:

$$x_0(n)=(½)\times s(n-1) \tag{1}$$

$$y_i(n)=x_0(n-1)+a_i\times x_0(n)\ \ i=1,6 \tag{2}$$

$$x_i(n)=x_0(n)+y_i(n-1)\ \ i=1,6 \tag{3}$$

$$y_i(n)=x_{i-1}(n-1)+a_i\times x_{i-1}(n)\ \ i=2,3,4,5,7,8,9,10 \tag{4}$$

$$x_i(n)=x_{i-1}(n)+y_i(n-1)\ \ i=2,3,4,5,7,8,9,10 \tag{5}$$

$$s(n) = e(n) + x_{10}(n) - x_9(n) - \sum_{i=1}^{10} y_i(n) \tag{6}$$

wherein s(n) is the digital speech synthesis data which is described above as DOUT with reference to FIG. 2, $\{a_i\}$ are the LSP speech synthesis coefficients, e(n) is the excitation signal, and $\{x_i\}$ and $\{y_i\}$ are media-parameters.

From the above equations, the LSP speech synthesis digital filter 210 requires 11 multiplications and 32 additions per sample, 10 multiplications for filter coefficients and one for amplitude (e(n)). The LSP synthesis digital filter 210 also needs 20 unit time delays.

The LSP speech synthesis ASIC 20 corresponds to the LSP speech synthesis block 12. Therefore, the handshaking signal HS includes the START, STOP, LDA, CKAD, END, etc., as shown in FIG. 2. The respective coefficient DOUT is the digital speech synthesis data s(n). The bus which couples the speech coefficients DS, data frame DF, is numbered 200.

Referring to FIG. 3, the LSP speech synthesis digital filter 210 receives a controlling signal Ctrl and a clock pulse signal Clk from the controller/timing generator 218, LSP speech synthesis coefficients $\{a_i\}$ from the coefficients register 208, and an excitation signal e(n) from the excitation buffer 216, and then outputs digital speech synthesis data s(n) to the D/A converter 217. The controller 30 receives the control signal Ctrl and the clock pulse signal Clk, and outputs several controlling signals C1, C2, C3, C4, C5, C6, and C7 to control the operations of the LSP speech synthesis digital filter 210. The controlling signal C1 is coupled to a register 34*a* and a FIFO (first in first out) register 35*a*. The controlling signal C2 is coupled to a 2-to-1 multiplexer 32*a* and a register 34*b*. The controlling signal C3 is coupled to a 2-to-1 multiplexer 32*b* and a register 34*c*. The controlling signal C4 is coupled to a FIFO register 35*b*. The controlling signal C5 is coupled to a register 34*d* and a register 34*e*. The controlling signal C6 is coupled to a 2-to-1 multiplexer 32*c* and a complementer 36. The controlling signal C7 is coupled to a serial shift multiplier 31.

The serial shift multiplier 31 is used for the operations of multiplication used in equations (2) and (4) to get $a_i x_{i-1}(n)$. The serial adder 33*a* is used for summing the results from serial shift adder 31 and the 2-to-1 multiplexer 32*c* to get $y_i(n)$. The data 310 may be $x_0(n)$ or $x_{i-1}(n)$ which is selected by the 2-to-1 multiplexer 32*a*. The data of 314 may be $x_0(n-1)$ or $x_{i-1}(n-1)$, which is selected by the 2-to-1 multiplexer 32*c*. The serial adder 33*b* is used for the operations of summation used in equations (3) and (5) to get $x_i(n)$. The output of FIFO register 35*a* is $y_i(n-1)$. The output of register 34*b* is $x_{i-1}(n)$. The serial adder 33*c* is used for the operations of summing in sequence from $y_i(n)$ to $y_{10}(n)$, $x_9(n)$, and $x_{10}(n)$ used in equation (6). The complementer 36 is used for the negative part which is used in equation (6). Under the control of the controlling signal C6, the complementer 36 may use a negative sign in complementing operation. The register 34*c* is used to store the result of each operation temporarily. Therefore, the serial adder 33*c*, the register 34*c* and the complementer 36 form an adder-subtracter to perform the operations in equation (6). Then the serial adder 33*d* is used to sum the final data 324 and excited signal e(n)

and produce the digital speech synthesis data s(n) to finish the operations in equation (6). In FIG. 3, s(n) is also denoted as data 326. Then the digital speech synthesis data s(n) 326 is shifted right one bit as the next media-parameters for sampling. All the 2-to-1 multiplexers are provided for reuse of the serial adders and the multipliers. The controller 30 generates the controlling signals for controlling the serial shift multiplier 31, the serial adders, the registers, the multiplexers, and the complementer 36 according to equations (1) to (6).

The serial shift multiplier 31 receives an LSP speech synthesis coefficient $\{a_i\}$ and data 310 from the 2-to-1 multiplexer 32*a*. Then the serial shift multiplier 31 outputs data 312 to a serial adder 33*a* under the control of the controlling signal C7. The serial adder 33*a* receives the data 312 and data from the 2-to-1 multiplexer 32*c*, and then outputs data $y_i(n)$ to the register 34*a*. The register 34*a* receives the data $y_i(n)$ and then outputs data 316 to the FIFO register 35*a* and the 2-to-1 multiplexer 32*b* by the control of the controlling signal C1. The FIFO register 35*a* receives the data 316 and then outputs data $y_i(n-1)$ to a serial adder 33*b* by the control of the controlling signal C1. The serial adder 33*b* receives the data $y_i(n-1)$ and the data 310 and then outputs data x(n) to a register 34*b*. The register 34*b* receives the data $x_i(n)$ and then outputs data $x_{i-1}(n)$ to the 2-to-1 multiplexer 32*a*, a 2-to-1 multiplexer 32*b*, and a FIFO register 35*b* under the control of the controlling signal C3. The 2-to-1 multiplexer 32*b* receives the data 316 and the data $x_i-1(n)$ and then outputs data 318 to a serial adder 33*c* under the control of the controlling signal C3. The serial adder 33*c* receives the data 318 and the data 320 from the complementer 36 and then outputs data 322 to the register 34*c*. The register 34*c* receives the data 322 and then outputs data 324 to the complementer 36 and a serial adder 33*d* under the control of the controlling signal C3. The complementer 36 receives the data 324 and then outputs the data 320 to the serial adder 33*c*. The serial adder 33*d* receives the data 324 and the excitation signal e(n) and then outputs the data s(n) 326 to a register 34*d* and the LSP speech synthesis ASIC. The register 34*d* receives the digital speech synthesis data s(n) 326 and then outputs digital speech synthesis data s(n) to the register 34*e* and the 2-to-1 multiplexer 32*a* under the control of the controlling signal C5. The register 34*e* receives the data s(n) 326 and then outputs data $x_0(n-1)$ to the 2-to-1 multiplexer 32*c* under the control of the controlling signal C5. The FIFO register 35*b* receives the data $x_i-1(n)$ and then outputs data $x_{i-1}(n-1)$ to the 2-to-1 multiplexer 32*c* under the control of the controlling signal C4. The 2-to-1 multiplexer 32*c* receives the data $x_0(n-1)$ and the data $x_{i-1}(n-1)$ and then outputs the data 314 under the control of controlling signal C6. The 2-to-1 multiplexer 32*a* receives the data $x_{i-1}(n)$ and the data s(n) 326 and then outputs the data 310.

As shown in FIG. 3, the loop which is formed by serial adder 33*c*, the register 34*c*, and the complementer 36, performs the function of an accumulator. The LSP speech synthesis digital filter 210 includes a controller, a serial shift multiplier, three 2-to-1 multiplexers, four serial adders, a complementer, and several registers. The operating rate demanded is low, and the multiplier and the adders are all in a serial shift structure. Thus, the area of the LSP speech synthesis ASIC is much less than that of the conventional chip.

Thus, the preferred embodiment of the LSP speech synthesis digital filter according to the invention includes a controller (30) which produces internal first through seventh controlling signals (C1–C7). A multiplier (31) is responsive to LSP speech synthesis coefficients $\{a_i\}$ from an external source (208), the seventh controlling signal (C7), and first data (310) to produce second data (312). A first adder (33*a*) is provided for adding the second data to third data (314) to produce fourth data ($y_i(n)$). A first register (34*a*) receives the fourth data and the first controlling signal (C1) and outputs fifth data (316). A first FIFO register (35*a*) receives the fifth data and the first controlling signal, and outputs sixth data ($y_i(n-1)$). A second adder (33*b*) is provided for adding the sixth data and the first data to produce seventh data ($x_i(n)$). A second register (34*b*) receives the seventh data and the second controlling signal (C2) and outputs eighth data ($x_{i-1}(n)$). A first multiplexer (32*b*) receives the eighth data, the fifth data (316), and the third controlling signal and outputs ninth data (318). A third adder (33*c*) adds the ninth data (318) to tenth data (320) and produces eleventh data (322). A third register (34*c*) receives the eleventh data and the third controlling signal and outputs twelfth data (324). A complementer (36) receives the twelfth data (324) and the sixth controlling signal (C6) and outputs the tenth data to the third adder (33*c*). A fourth adder (33*d*) adds the twelfth data (324) and the excitation signal (e(n)) to produce digital speech synthesis data (s(n) 326). A fourth register (34*d*) receives the digital speech synthesis data and the fifth controlling signal (C5) and outputs thirteenth data (s(n)). A fifth register (34*e*) receives the thirteenth data and outputs fourteenth data ($x_0(n-1)$). A second FIFO register (35*b*) receives the eighth data ($x_{i-1}(n)$) and the fourth controlling signal (C4) and outputs fifteenth data ($x_{i-1}(n-1)$). A second multiplexer (32*c*) receives the fourteenth data and the fifteenth data and outputs the third data (314). A third multiplexer (32*a*) receives the eighth data and the thirteenth data and outputs the first data (310).

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. An LSP speech synthesis digital filter, comprising:

a controller which produces internal controlling signals, including a first controlling signal, a second controlling signal, a third controlling signal, a fourth controlling signal, a fifth controlling signal, a sixth controlling signal, and a seventh controlling signal;

a multiplier, which is responsive to LSP speech synthesis coefficients $\{a_i\}$ from an external source, the seventh controlling signal, and first data to produce second data;

a first adder, for adding the second data to third data to produce fourth data;

a first register, which receives the fourth data and the first controlling signal and outputs fifth data;

a first FIFO register, which receives the fifth data and the first controlling signal, and outputs sixth data;

a second adder, for adding the sixth data and the first data to produce seventh data;

a second register, which receives the seventh data and the second controlling signal and outputs eighth data;

a first multiplexer, which receives the eighth data, the fifth data, and the third controlling signal and outputs ninth data;

a third adder, which adds the ninth data to tenth data and produces eleventh data;

a third register, which receives the eleventh data and the third controlling signal and outputs twelfth data;

a complementer, which receives the twelfth data and the sixth controlling signal and outputs the tenth data to the third adder;

a fourth adder, which adds the twelfth data and the excitation signal to produce digital speech synthesis data;

a fourth register, which receives the digital speech synthesis data and the fifth controlling signal and outputs thirteenth data;

a fifth register, which receives the thirteenth data and outputs fourteenth data;

a second FIFO register, which receives the eighth data and the fourth controlling signal and outputs fifteenth data;

a second multiplexer, which receives the fourteenth data and the fifteenth data and outputs the third data; and a third multiplexer, which receives the eighth data and the thirteenth data and outputs the first data.

2. A digital filter according to claim 1, wherein the multiplier is a serial shift multiplier.

3. A digital filter according to claim 1, wherein the first multiplexer, the second multiplexer, and the third multiplexer are 2-to-1 multiplexers.

4. A digital filter according to claim 1, wherein the first adder, the second adder, the third adder, and the fourth adder are serial adders.

5. An LSP speech synthesis device which receives external handshaking/control signals and at least one data frame having speech coefficients, the device comprising an LSP speech synthesis digital filter according to claim 1, and the device further comprising:

a controller timing generator which provides a control signal and a clock signal to the controller of the LSP speech synthesis digital filter;

a pitch register which stores the pitch length of the at least one data frame;

a frame register which stores the frame length of the at least one data frame;

a gain register which stores a gain parameter of the at least one data frame;

a parameter converter converts encoded LSP parameters into LSP speech synthesis coefficients;

a coefficients register which stores the LSP speech synthesis coefficients from the parameter converter, and provides the LSP speech synthesis coefficients to the multiplier of the LSP speech synthesis digital filter;

a pulse train generator which receives the stored pitch length from the pitch register and generates a Hilbert sequence to simulate a voiced sound source;

a white noise generator which generates a 15th order M-sequence as an un-voiced sound source;

a switch which receives the sequences from the pulse train generator and the white noise source, and outputs one of the sequences based on the pitch length stored in the pitch register;

an excitation buffer which receives the output from the switch and the gain parameter from the gain register, and provides the excitation signal to the fourth adder of the LSP speech synthesis digital filter; and a digital to analog converter which receives the digital speech synthesis data from the fourth adder of the LSP speech synthesis digital filter, and outputs analog synthesized speech.

6. The device according to claim 5, wherein the controller timing generator exchanges hand-shaking and control signals with a central processor which also provides the at least one data frame having speech coefficients to the device.

* * * * *